US006402567B1

(12) United States Patent
Zhu

(10) Patent No.: US 6,402,567 B1
(45) Date of Patent: Jun. 11, 2002

(54) ELECTRICAL CONNECTOR HAVING IMPROVED SPRING CONTACT MEMBER

(75) Inventor: ZiQiang Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/894,458

(22) Filed: Jun. 27, 2001

(30) Foreign Application Priority Data

May 25, 2001 (TW) ..... 90208636 U

(51) Int. Cl.[7] ..... H01R 13/24
(52) U.S. Cl. ..... 439/700; 439/66
(58) Field of Search ..... 439/66, 700

(56) References Cited

U.S. PATENT DOCUMENTS 5,427,535 A * 6/1995 Sinclair ..... 439/66
5,667,410 A * 9/1997 Johnston ..... 439/700
5,967,856 A * 10/1999 Meller ..... 439/700
6,083,059 A * 7/2000 Kuan ..... 439/700
6,095,823 A * 8/2000 Banks ..... 439/66

* cited by examiner

*Primary Examiner*—Gary F. Paumen
(74) *Attorney, Agent, or Firm*—Wei Te Chung

(57) ABSTRACT

An electrical connector comprises an insulative housing (1) and a spring contact member (2). The insulative housing defines a plurality of receiving passageways (16) arranged in a slant direction. The spring contact member received in the receiving passageway comprises an engaging portion (21) electrically connecting with a complementary device, a serpentine spring body (22) extended from the engaging portion and a Z-shape soldering portion (23) connected with the end of the spring body. The spring contact member has simple manufacture and is easy to assemble and low cost. When the electrical connector connects with the complementary device, the engaging portion of the spring contact member can move and equalize the mating tolerance by the retractility function of the spring body. The joint of the Z-shape soldering portion and the PCB produces a good soldering effect.

1 Claim, 7 Drawing Sheets

ELECTRICAL CONNECTOR HAVING IMPROVED SPRING CONTACT MEMBER

FIELD OF THE INVENTION

The present invention relates to an electrical connector, and more particularly to an electrical connector having an improved spring contact member and adapted for mating with computer peripheral devices.

DESCRIPTION OF THE PRIOR ART

An electrical connector having spring contact combination has been widely used in computer peripheral devices (for example printers). Referring to FIG. 7, a conventional connector of this type comprises an insulative housing 6 and a plurality of spring contact combination 4. The insulative housing 6 comprises a plurality of stepped receiving passageways 63 through a top face 61 and a bottom face 62 thereof. The receiving passageway 63 defines an internal threaded hole 630 at a bottom thereof. The bottom face 62 of the insulative housing 6 extends downward a plurality of supporting portions 64. The spring contact combination 4 received in the receiving passageway 63 of the insulative housing 6 comprises a contact head 41, a spring 42 and a sleeve 43 for fixing the contact head 41 and the spring 42. The contact head 41 defines a first portion 410. The first portion 410 defines a bottom face 4104. The spring 42 biases against the bottom face 4104 of the first portion 41. A second portion 412 extends downward from the first portion 410 and is received in the spring 42. The first portion 410 comprises a recess 4102 in the middle thereof and a conical engage section 4100 for connecting with other complementary device, for example a printed circuit board (not shown). The sleeve 43 comprises a cylindrical receiving portion 430 receiving the contact head 41 and the spring 42, and a cylindrical soldering leg 432 integrally extending downward from the receiving portion 430. The soldering leg 432 defines an outer threaded portion 4320 to engage with the internal threaded hole 630 of the receiving passageways 63 of the insulative housing 6. An inwardly projecting 434 extends from the receiving portion 430 to engage with the recess 4102 of the first portion 410.

In assembly, the spring 42 and the contact head 41 are pressed into the receiving portion 430 of the sleeve 43 in turn. The projecting 434 engage with the recess 4102 so that the contact head 41 and the spring 42 will not separate from the sleeve 43. Then, the spring contact combination 4 is rotated to threadedly engage the receiving passageways 63 from the top face 61 of the insulative housing 6 and fixed in the insulative housing 6. The soldering leg 432 of the spring contact combination 4 is soldered onto a corresponding printed circuit board (PCB) 5 through the Surface Mount Technology (SMT). The supporting portions 64 are supported on the PCB 5 so as to make the electrical connector connect with the PCB 5.

However, it is very difficult to assemble the spring contact combination 4 which is made of the contact head 41, the spring 42 and the sleeve 43. The contact head 41, the spring 42 and the sleeve 43 are respectively made by special equipments and the overall cost is high. In addition, because the soldering leg 432 of the spring contact combination 4 is soldered onto a corresponding printed circuit board (PCB) 5 through SMT, the circular bottom face of the soldering leg 432 does not present a large soldering area such that the effect of soldering is not good.

Hence, an improved electrical connector is desired to overcome the disadvantages of the prior art connector.

SUMMARY OF THE INVENTION

It is an object of this invention to provide an electrical connector, and more particularly to an electrical connector having an improved spring contact member having simple manufacture, easy assembly and low cost.

It is still an object of this invention to provide a spring contact member which its soldering leg has good effect of soldering and can connect with the PCB steadily.

It is another object of this invention to provide an electrical connector having a contact spring member which its receiving passageways of the insulative housing are slant so as to shorten the transverse dimension of the electrical connector and stint the space of the PCB.

In order to achieve the objective set forth, an electrical connector in accordance with the present invention comprises an insulative housing and a spring contact member. The insulative housing defines a plurality of receiving passageways arranged in a slant direction. The bottom wall of the insulative housing defines a plurality of rectangular protrusions communicating with a plurality of corresponding receiving passageways and two adjacent protrusions are separated by a groove therebetween. The spring contact members are inserted into the receiving passageways of the insulative housing through auto-assembling. Each spring contact member made of metal sheet and integer stroke out comprises an engaging portion electrically connecting with a complementary device, a spring body extended from the engaging portion and continuously folding, a fixing portion having a pair of barbs opposite and connected with the spring body and a Z-shape soldering portion which is connected with the fixing portion of the spring body, protrudes the protrusion of the insulative housing and solders onto the PCB. The spring contact member has simple manufacture and is easy to assemble and low cost. When the electrical connector connect with the complementary device, the engaging portion of the spring contact member can move and equalize the mating tolerance by the retractility function of the spring body so that the electrical connector can electrically connect with the complementary device steadily. The joint of the Z-shape soldering portion and the PCB forms two triangular soldering areas having better sorption and hold soldering tin so as to make the soldering portion have good soldering effect. In addition, the groove between two protrusions of the insulative housing can help to cool in the process of the soldering and cooling quickly after soldering and get more reliable connection so that the electrical connector can connect onto the PCB steadily.

Other objects, advantages and novel features of the invention will become more apparent from the following detailed description of the present embodiment when taken in conjunction with the accompanying drawings.

DETAILED DESCRIPTION OF THE INVENTION

Figure 1:
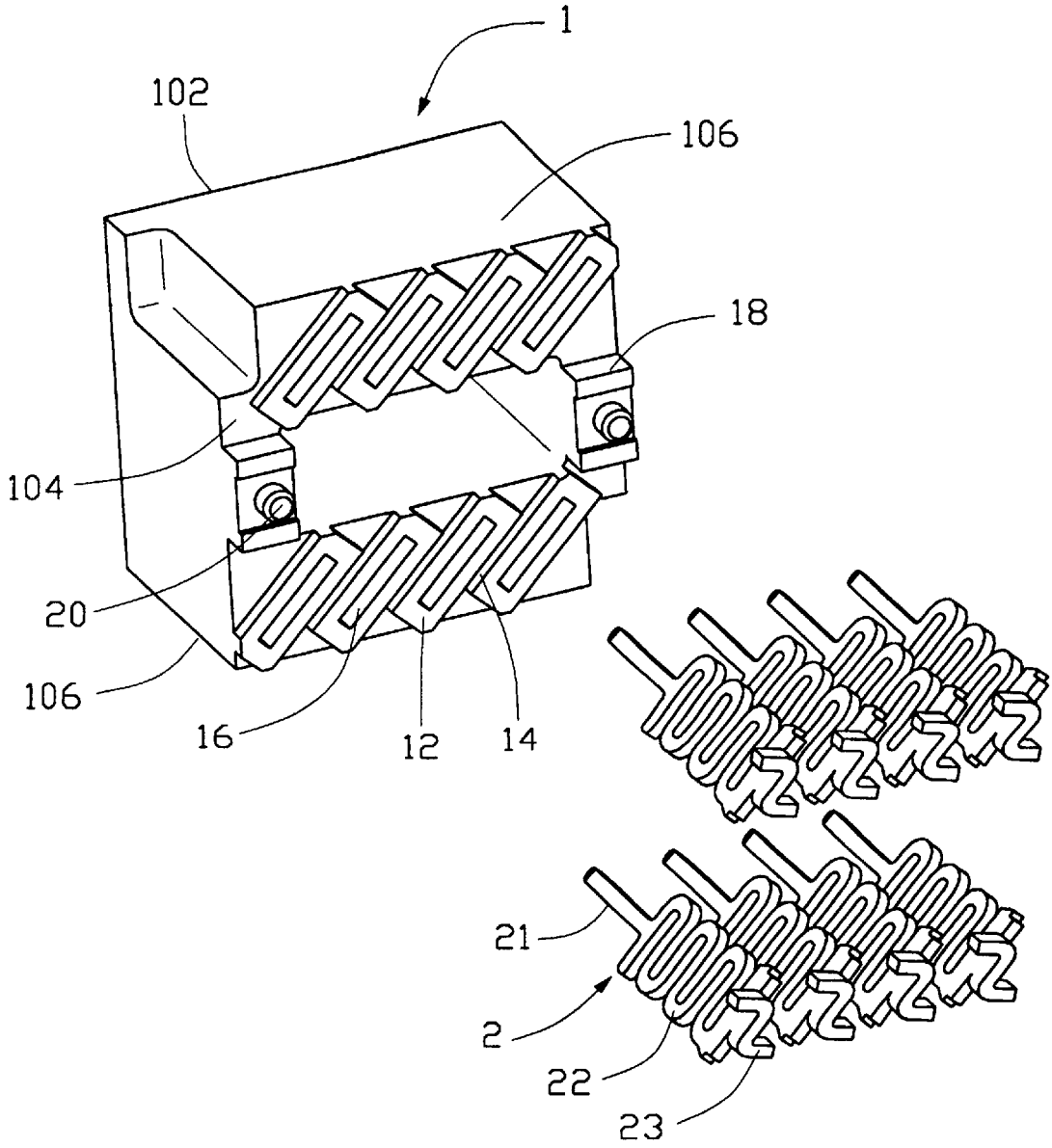
FIG. 1 is an exploded perspective view of an electrical connector in accordance with the present invention.
Figure 2:
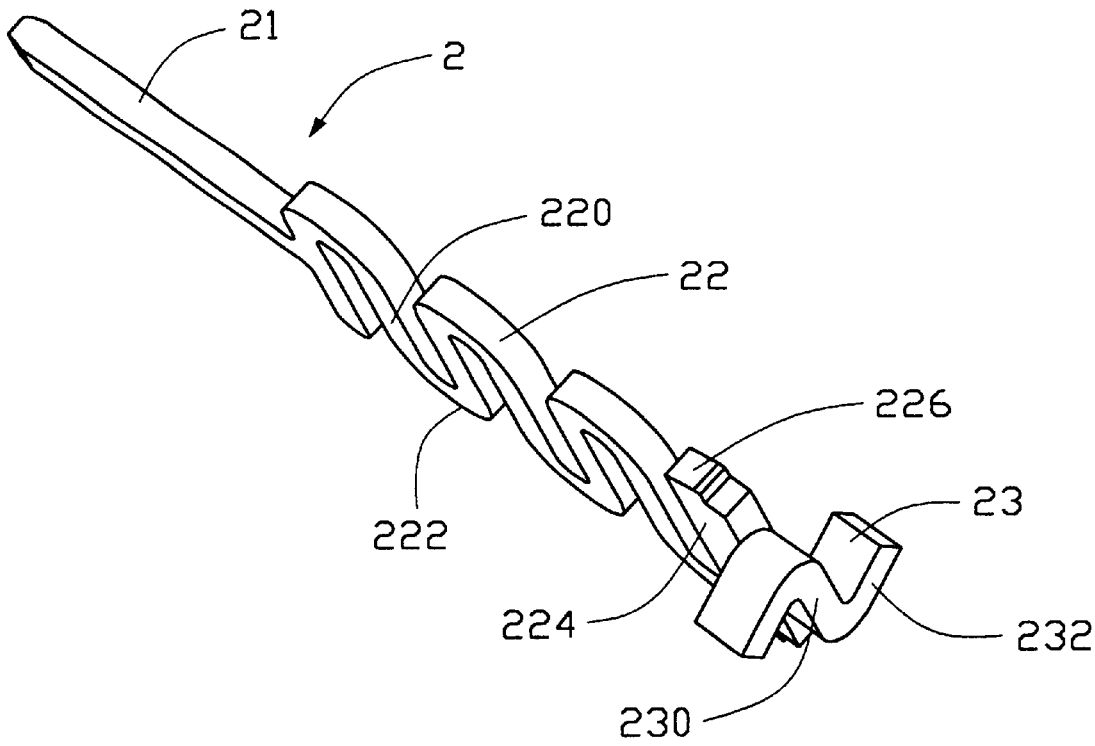
FIG. 2 is a perspective view of a spring contact member of the electrical connector in accordance with the present invention.
Figure 3:
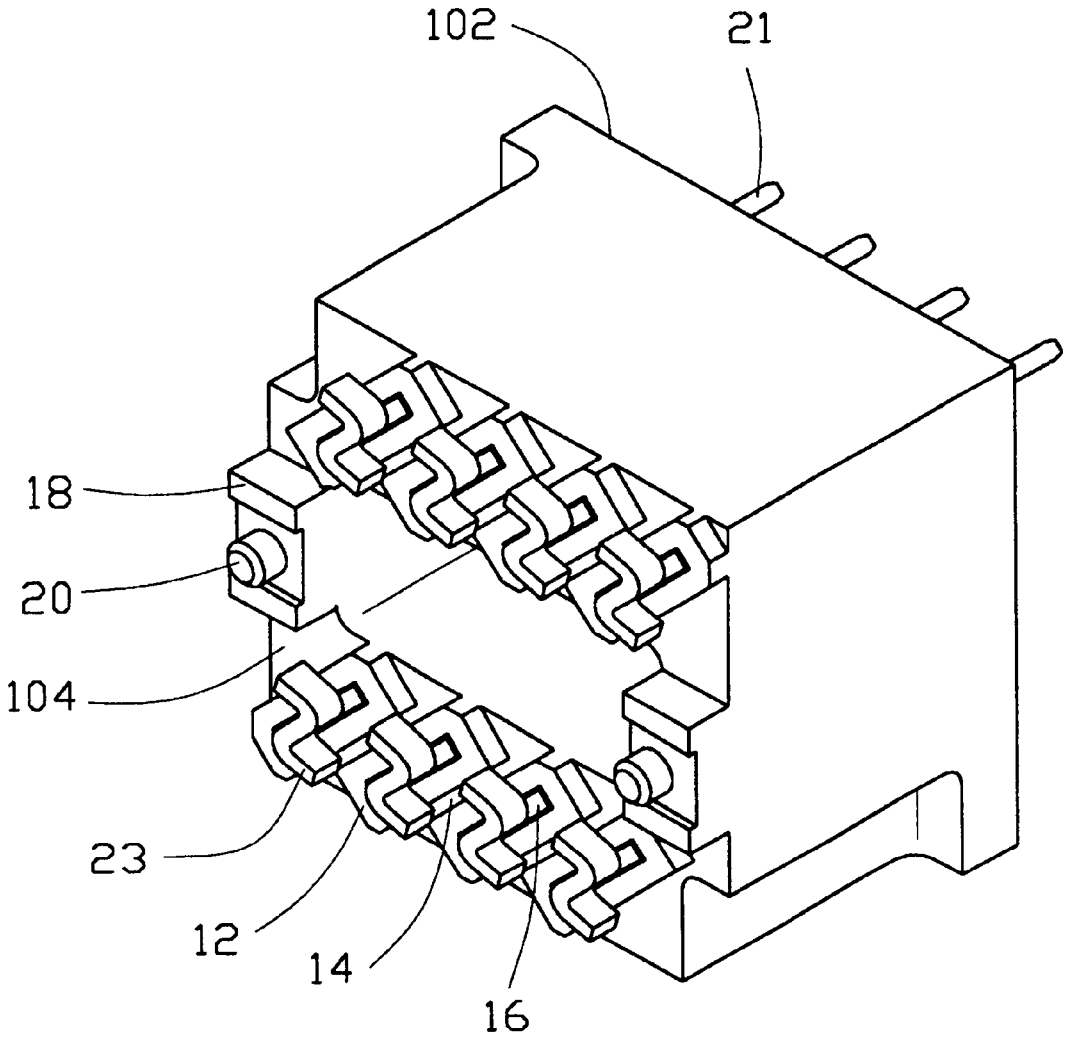
FIG. 3 is an assembled view of FIG. 1.
Figure 4:
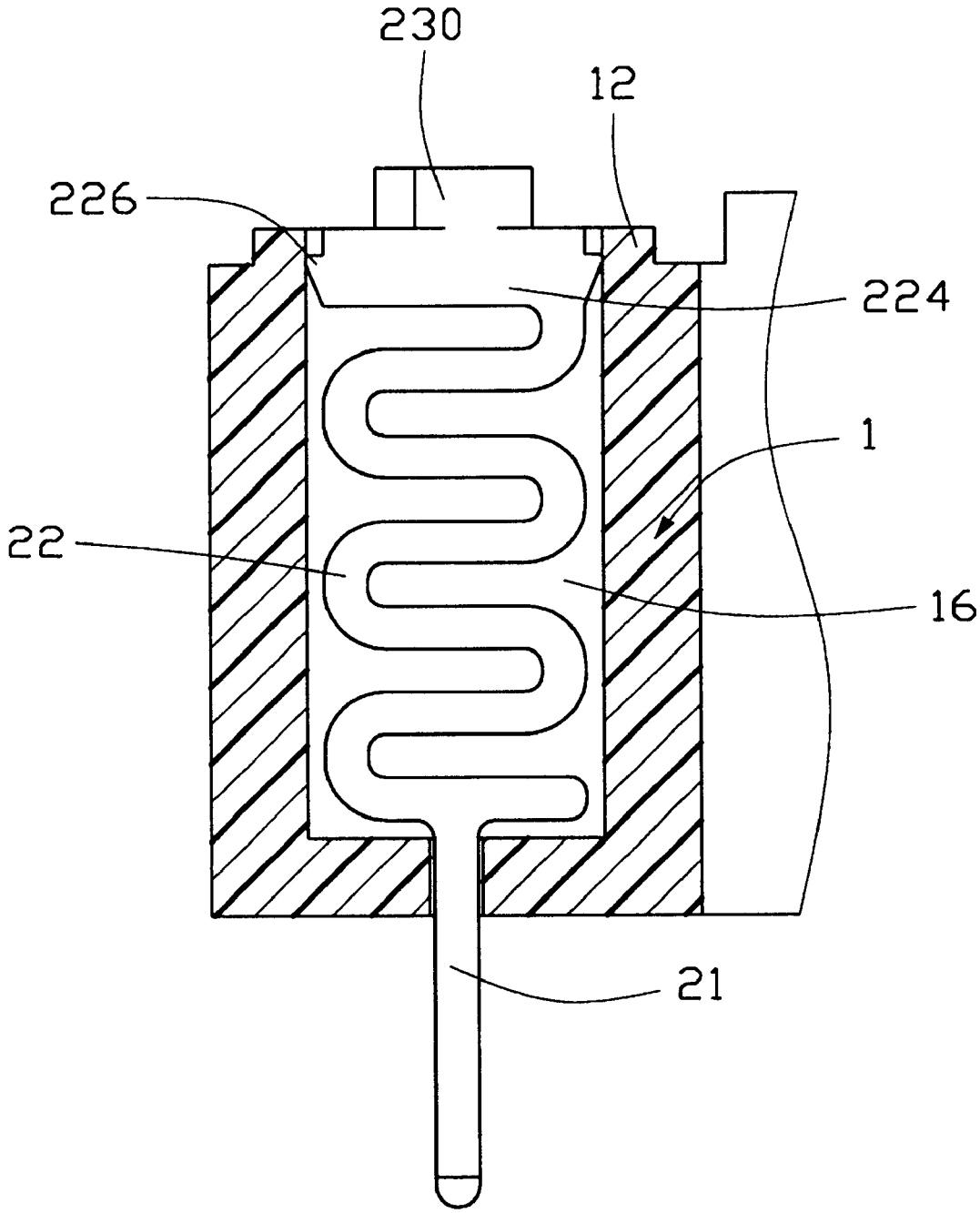
FIG. 4 is a sectional exploded view of FIG. 3.
Figure 5:
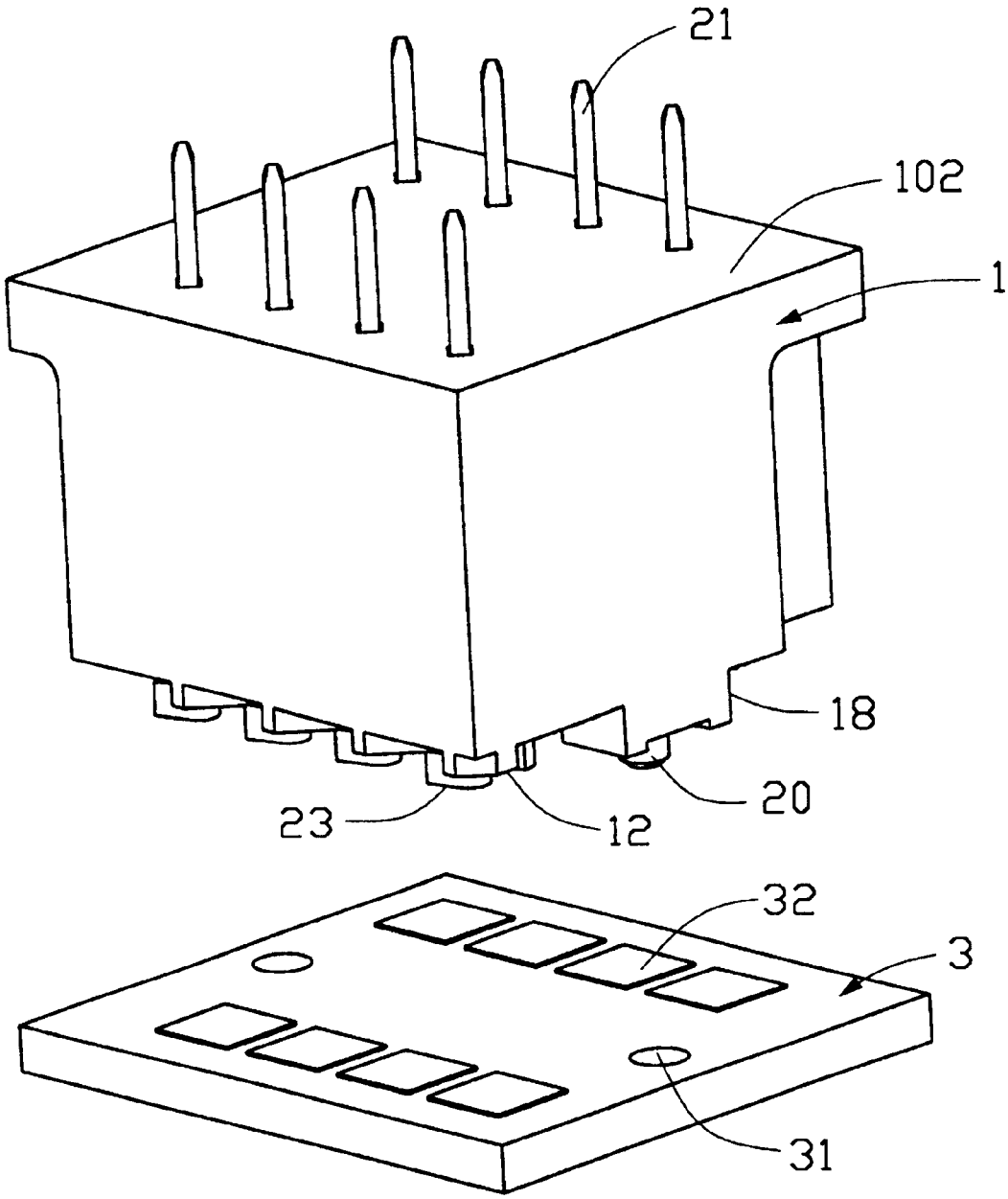
FIG. 5 is a perspective view of the electrical connector in accordance with the present invention is not assembled onto the PCB.

Referring FIG. 1 and FIG. 2, an electrical connector in accordance with the present invention includes an insulative housing 1 and a plurality of spring contact members 2. The insulative housing 1 comprises a top wall 102 faced a complementary device (not shown), a bottom wall 104 faced a printed circuit board (PCB) 3 (referring to FIG. 5) and side walls 106 between the top wall 102 and the bottom wall 104. A plurality of long receiving passageways 16 communicates with the top wall 102 and the bottom wall 104. The receiving passageways 16 are slant. The bottom wall 104 of the insulative housing 1 defines a plurality of rectangular protrusions 12 communicating with the corresponding receiving passageways 16 and two adjacent protrusions 12 are separated by a groove 14 therebetween. A pair of bulges 18 is respectively defined on two opposite ends of the bottom wall 104 of the insulative housing 1 and between the two rows protrusions 12 as said. The bulges 18 respectively define a post 20.

The spring contact members 2 are received in the receiving passageways 16 of the insulative housing 1. Each spring contact member 2 made of metal sheet and integer stroke out comprises a spiculate engaging portion 21 electrically connecting with a complementary device (not shown), a serpentine spring body 22 extended from the engaging portion 21 and continuously folding, a fixing portion 224 having a pair of barbs 226 on opposite side thereof and connected with the spring body 22 and a Z-shape soldering portion 23 which is connected with the fixing portion 224 of the spring body 22, protrudes the protrusion 12 of the insulative housing 1 and solders onto the PCB 3. The soldering portion 23 comprises a central portion 230 connected with the body 22 and a pair of end sections 232 extending serpentine from the central portion 230 and the plane which the end sections 232 lie in is different from the plane of the spring body 22. The spring body 22 comprises a plurality of spring portions 220 and a plurality of arch-like portions 222. One end of the spring portion 220 connects with an end portion (not labeled) of the fixing portion 224. The other end of the spring portion 220 having a straight portion (not labeled) connects with the engaging portion 21 at a middle thereof.

Referring to FIG. 1, FIG. 3 to FIG. 5, when the spring contact members 2 are inserted into the receiving passageways 16 of the insulative housing 1, the engaging portions 21 of the spring contact members 2 protrude out of the top wall 102 of the insulative housing 1. The spring body 22 is received in the receiving passageway 16 and the barbs 226 of the fixing portion 224 can lock the receiving passageway 16 of the insulative housing 1. The soldering portion 23 protrudes out of the bottom wall 104 of the insulative housing 1.

Figure 6:
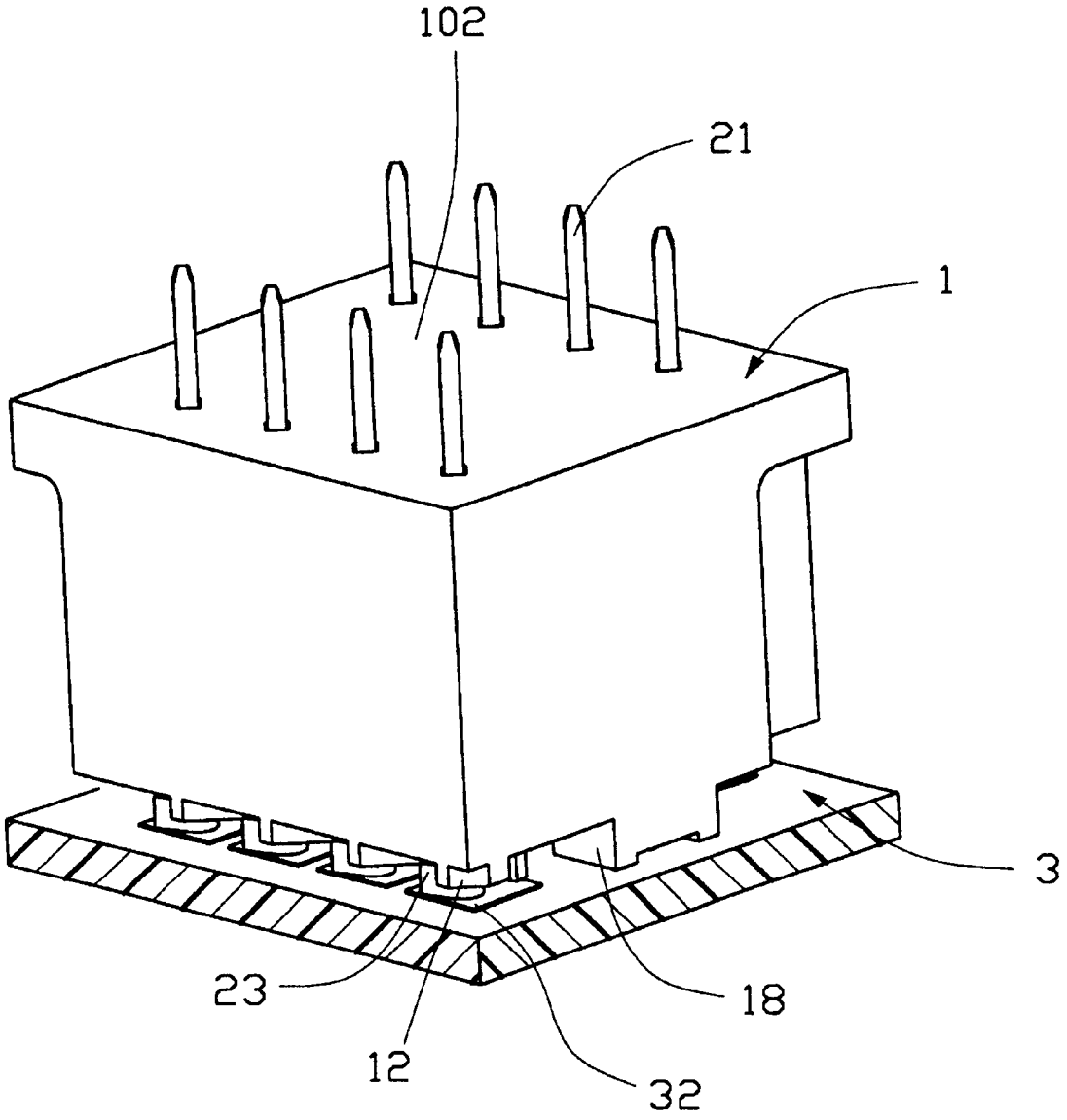
FIG. 6 is a perspective view of the electrical connector in accordance with the present invention is assembled onto the PCB.
Figure 7:
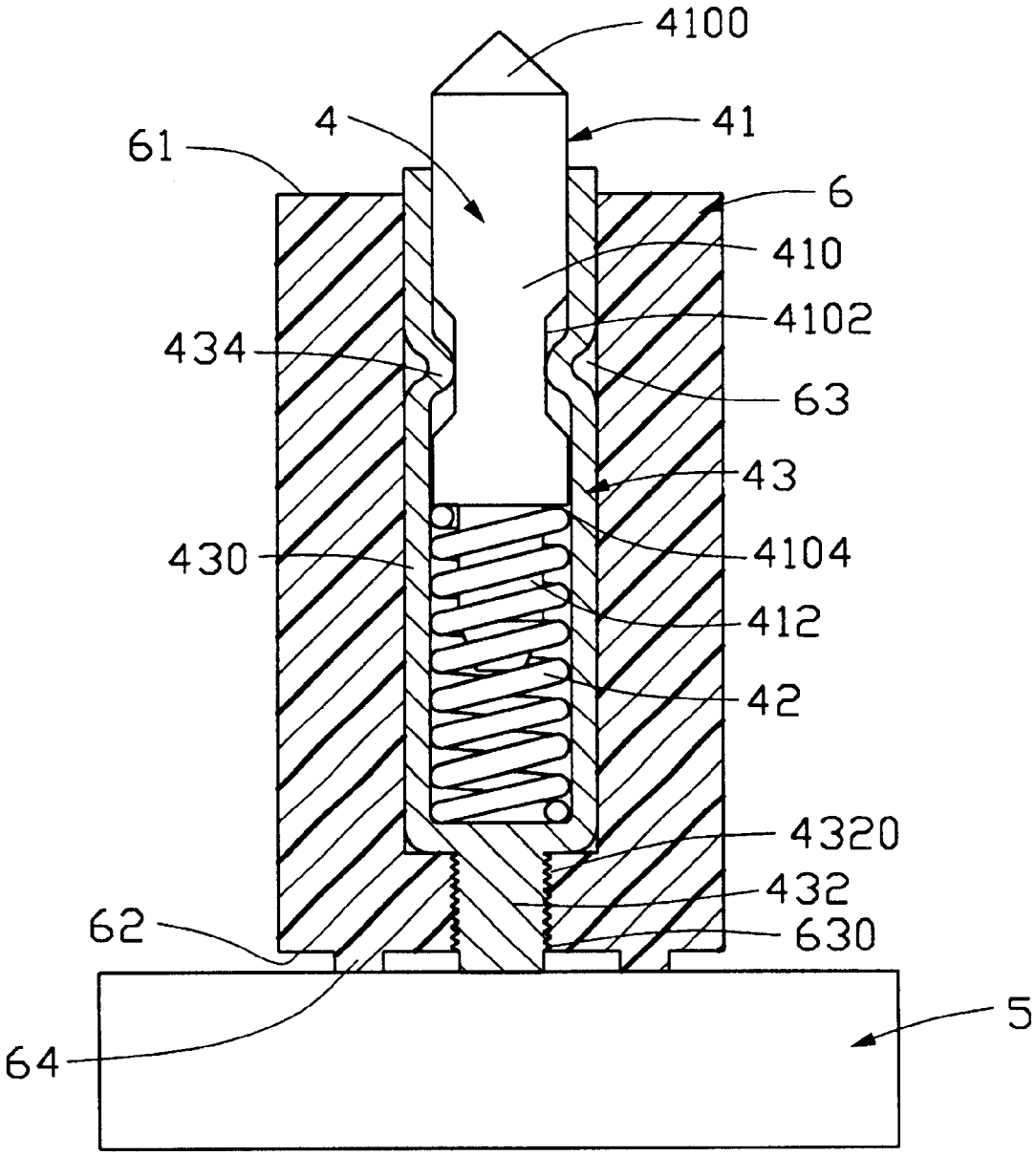
FIG. 7 (PRIOR ART)
FIG. 7 is a sectional view of a conventional electrical connector assembled onto the PCB.

When the electrical connector having the improved spring contact members 2 is mounted onto the PCB 3 (referring to FIG. 6), the posts 20 of the bulges 18 of the insulative housing 1 are inserted into the corresponding holes 31 (referring to FIG. 5) of the PCB 3 and the bulges 18 support on the PCB 3 so as to provide the orientation and support function to the electrical connector. When the Z-shape soldering portion 23 of the spring contact member 2 is soldered onto the corresponding solder pad 32 of the PCB 3, the joint of the Z-shape soldering portion 23 and the PCB 3 forms two triangular soldering areas having better sorption and hold soldering tin so as to make the soldering portion 23 have good soldering effect. In addition, the groove 14 between two protrusions 12 of the insulative housing 1 can help to cool in the process of the soldering and cooling quickly after soldering and get more reliable connection so that the electrical connector can connect onto the PCB steadily. At the same time, when the electrical connector connects with the complementary device (not shown), the engaging portion 21 of the spring contact member 2 can move and equalize the mating tolerance by the retractility function of the spring body 22 so that the electrical connector can electrically connect with the complementary device reliably. Because the receiving passageways 16 of the insulative housing 1 are slant so as to shorten the transverse dimension of the electrical connector and stint the space of the PCB 3 in some direction. And the spring contact members 2 made of metal sheet and integer stroke out are inserted into the receiving passageways 16 of the insulative housing 1 through auto-assembling and have simple manufacture and is easy to assemble and low cost.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for mounting onto a printed circuit board (PCB), comprising:

an insulative housing comprising a top wall, a bottom wall facing a PCB, and a plurality of receiving passageways extending through the top wall and the bottom wall; and a plurality of spring contact members each comprising a fixing portion secured in the passageway, a serpentine spring body connected with the fixing portion and received in the receiving passageway, an engaging portion connected with the spring body and protruding beyond the top wall, and a soldering portion connected with the fixing portion of the spring body and protruding beyond the bottom wall of the insulative housing, the soldering portion comprising a central portion connected with the fixing portion and a pair of angled end sections;

wherein the soldering portion of Z-shape;

wherein the spring body comprises a pluarality of spring portions and a plurality of arch-like portions, one end of the spring portion connecting with an end portion of the fixing portion, the other end of the spring portion having a straight portion connecting with the engaging portion at a middle thereof;

wherein the fixing portion has a pair of barbs on opposite ends thereof;

wherein the receiving passageways are slanted;

wherein the bottom wall of the insulative housing defines a plurality of retangular protrusions, each protrusion communicating wit a corresponding receiving passageway;

wherein two adjacent protrusions are separated by a groove therebetween;

wherein a pair of bulges is respectively defined on two opposite ends of the bottom wall of the insulative housing and the bulges respectively define a post.

* * * * *